US011347175B2

(12) United States Patent
Kinoshita et al.

(10) Patent No.: US 11,347,175 B2
(45) Date of Patent: May 31, 2022

(54) CLEANING DEVICE CAPABLE OF PREVENTING A CONVEYANCE MEMBER FROM CONTACTING A BRUSH-LIKE ROTATION BODY AND A COLLECTION MEMBER, DRUM UNIT, AND IMAGE FORMING APPARATUS

(71) Applicant: Konica Minolta, Inc., Tokyo (JP)

(72) Inventors: Takeru Kinoshita, Toyokawa (JP); Junji Murakawa, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/472,440

(22) Filed: Sep. 10, 2021

(65) Prior Publication Data

US 2022/0113669 A1 Apr. 14, 2022

(30) Foreign Application Priority Data

Oct. 12, 2020 (JP) ..... JP2020-171874

(51) Int. Cl.
*G03G 21/00* (2006.01)
*G03G 21/10* (2006.01)

(52) U.S. Cl.
CPC ..... *G03G 21/0035* (2013.01); *G03G 21/105* (2013.01)

(58) Field of Classification Search
CPC ..... G03G 21/0035; G03G 21/105
USPC ..... 399/353, 354, 358
See application file for complete search history.

(56) References Cited

U.S. PATENT DOCUMENTS 5,212,530 A * 5/1993 Harada et al. ..... G03G 21/0035 399/353
5,663,788 A * 9/1997 Sanpe ..... G03G 21/0035 399/353
6,539,197 B2 * 3/2003 Waterschoot ..... G03G 21/0035 399/353
9,170,554 B2 * 10/2015 Kojima et al. ..... G03G 21/0035
2008/0145118 A1 * 6/2008 Nakayama et al. ..... G03G 21/0035 399/354
2015/0063887 A1 * 3/2015 Asaoka et al. ..... G03G 21/105 399/353

FOREIGN PATENT DOCUMENTS

JP 2014-074776 A 4/2014

* cited by examiner

*Primary Examiner* — William J Royer
(74) *Attorney, Agent, or Firm* — Squire Patton Boggs (US) LLP

(57) ABSTRACT

A cleaning device includes: a brush-like rotation body that collects residual toner adhering to a photoreceptor from the photoreceptor and holds the residual toner; a collection member that is disposed so as to be in contact with the brush-like rotation body and collects the residual toner held by the brush-like rotation body from the brush-like rotation body; a blade member that scrapes off the residual toner collected by the collection member from the collection member; a conveyance member that is disposed below the brush-like rotation body and the collection member and conveys the residual toner scraped off from the collection member by the blade member; and a restriction part that is disposed above the conveyance member and restricts contact of the conveyance member with the brush-like rotation body and the collection member.

7 Claims, 14 Drawing Sheets

CLEANING DEVICE CAPABLE OF PREVENTING A CONVEYANCE MEMBER FROM CONTACTING A BRUSH-LIKE ROTATION BODY AND A COLLECTION MEMBER, DRUM UNIT, AND IMAGE FORMING APPARATUS

The entire disclosure of Japanese patent Application No. 2020-171874, filed on Oct. 12, 2020, is incorporated herein by reference in its entirety.

BACKGROUND

Technological Field

The present disclosure relates to a cleaning device, a drum unit, and an image forming apparatus.

Description of the Related Art

In the related art, a cleaning device, which removes toner remaining on a surface of a photoreceptor, is known. For example, JP 2014-74776 A discloses a cleaning device including a cleaning brush that removes residual toner adhering to a photoreceptor drum, a collection roller that collects the residual toner from the cleaning brush, a metal blade that mechanically removes the residual toner from the collection roller, and a conveyance screw that conveys the residual toner scraped off from the collection roller. The conveyance screw is disposed below the cleaning brush and the collection roller.

In the cleaning device described in JP 2014-74776 A, there is a concern that the conveyance screw comes into contact with the cleaning brush or the collection roller due to vibration or the like during operation.

SUMMARY

An object of the present disclosure is to provide a cleaning device capable of preventing a conveyance member from coming into contact with a brush-like rotation body and a collection member, a drum unit, and an image forming apparatus.

To achieve the abovementioned object, according to an aspect of the present invention, a cleaning device reflecting one aspect of the present invention comprises: a brush-like rotation body that collects residual toner adhering to a photoreceptor from the photoreceptor and holds the residual toner; a collection member that is disposed so as to be in contact with the brush-like rotation body and collects the residual toner held by the brush-like rotation body from the brush-like rotation body; a blade member that scrapes off the residual toner collected by the collection member from the collection member; a conveyance member that is disposed below the brush-like rotation body and the collection member and conveys the residual toner scraped off from the collection member by the blade member; and a restriction part that is disposed above the conveyance member and restricts contact of the conveyance member with the brush-like rotation body and the collection member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

and

Figure 15:
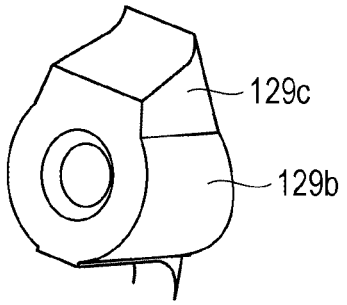

FIG. 15 is a perspective view illustrating a modified example of a fixing portion.

DETAILED DESCRIPTION OF EMBODIMENTS

Hereinafter, one or more embodiments of the present invention will be described with reference to the drawings. However, the scope of the invention is not limited to the disclosed embodiments. In the drawings below, the same or corresponding members are denoted by the same reference numerals.

Figure 1:
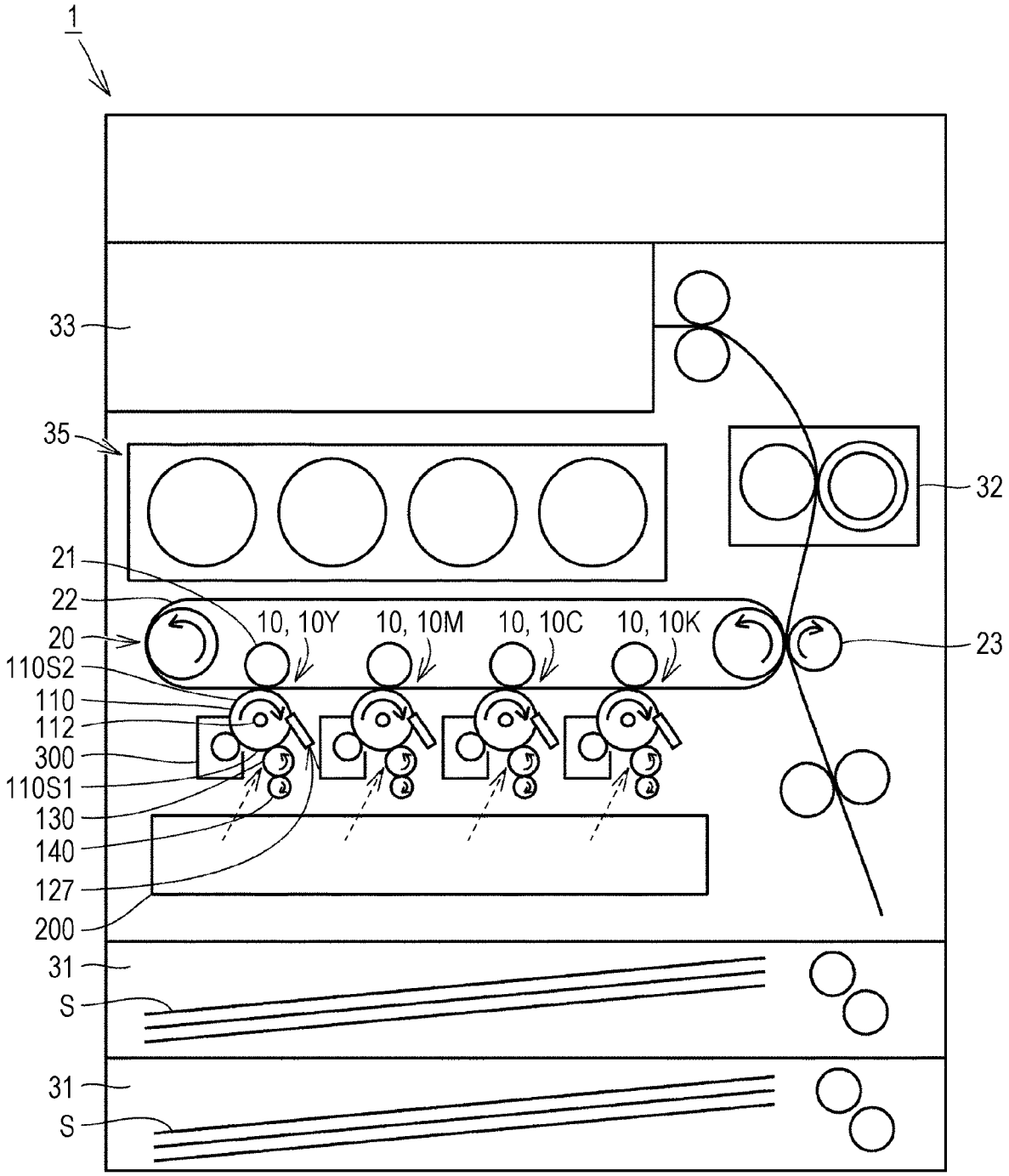
FIG. 1 is a diagram schematically illustrating an overall configuration of an image forming apparatus according to an embodiment of the present disclosure.

FIG. 1 is a diagram schematically illustrating an overall configuration of an image forming apparatus 1 according to an embodiment of the present invention. The image forming apparatus 1 is a multifunctional peripheral (M P) having a plurality of functions such as a copy function, a facsimile function, a printer function, and a scanner function.

As illustrated in FIG. 1, the image forming apparatus 1 includes an image former 10 (10Y, 10M, 10C, and 10K), a transfer device 20, a sheet feeding tray 31, a fixing device 32, a sheet discharging tray 33, and a toner supply device 35.

The image former 10 forms a toner image (image) to be transferred to the transfer device 20. The image former 10Y, the image former 10M, the image former 10C, and the image former 10K respectively form toner images having colors of yellow (Y), magenta (M), cyan (C), and black (K) on the transfer device 20.

The transfer device 20 includes a primary transfer roller 21, an intermediate transfer belt 22, and a secondary transfer roller 23. The toner images of the respective colors formed by the image former 10 are superimposed on a surface of the intermediate transfer belt 22. Thereafter, the intermediate transfer belt 22 conveys a color toner image to a secondary transfer portion formed between the intermediate transfer belt 22 and the secondary transfer roller 23.

The sheet feeding tray 31 is provided as a storage portion that stores a sheet S as a recording medium. A plurality of sheets S is stored in the sheet feeding tray 31. In the embodiment, the sheet feeding tray 31 is provided to have two stages in a vertical direction. However, the sheet feeding tray 31 may be provided to have one or three or more stages in the vertical direction.

The sheet S stored in the sheet feeding tray 31 is conveyed to the secondary transfer portion between the intermediate transfer belt 22 and the secondary transfer roller 23 by various rotation rollers. The color toner image carried on the intermediate transfer belt 22 is transferred to a surface of the sheet S at the secondary transfer portion. The color toner image is fixed to the surface of the sheet S by the fixing device 32. The sheet S on which the image is formed by the above process is discharged to the sheet discharging tray 33.

The toner supply device 35 supplies toner (developer) to a developing device 300 of the image former 10. The toner contains a treatment agent (lubricant, abrasive, or the like) for prolonging a life of a photoreceptor 110. The toner supply device 35 is provided between the intermediate transfer belt 22 and the sheet discharging tray 33 in the vertical direction. However, the arrangement of the toner supply device 35 in the image forming apparatus 1 is not particularly limited.

Here, details of the image former 10 will be described. As illustrated in FIGS. 1 to 4, the image former 10 includes a drum unit 100, an exposure device 200, and the developing device 300.

The drum unit 100 includes the photoreceptor 110, a cleaning device 120, a charging roller 130, and a cleaning roller 140.

Figure 3:
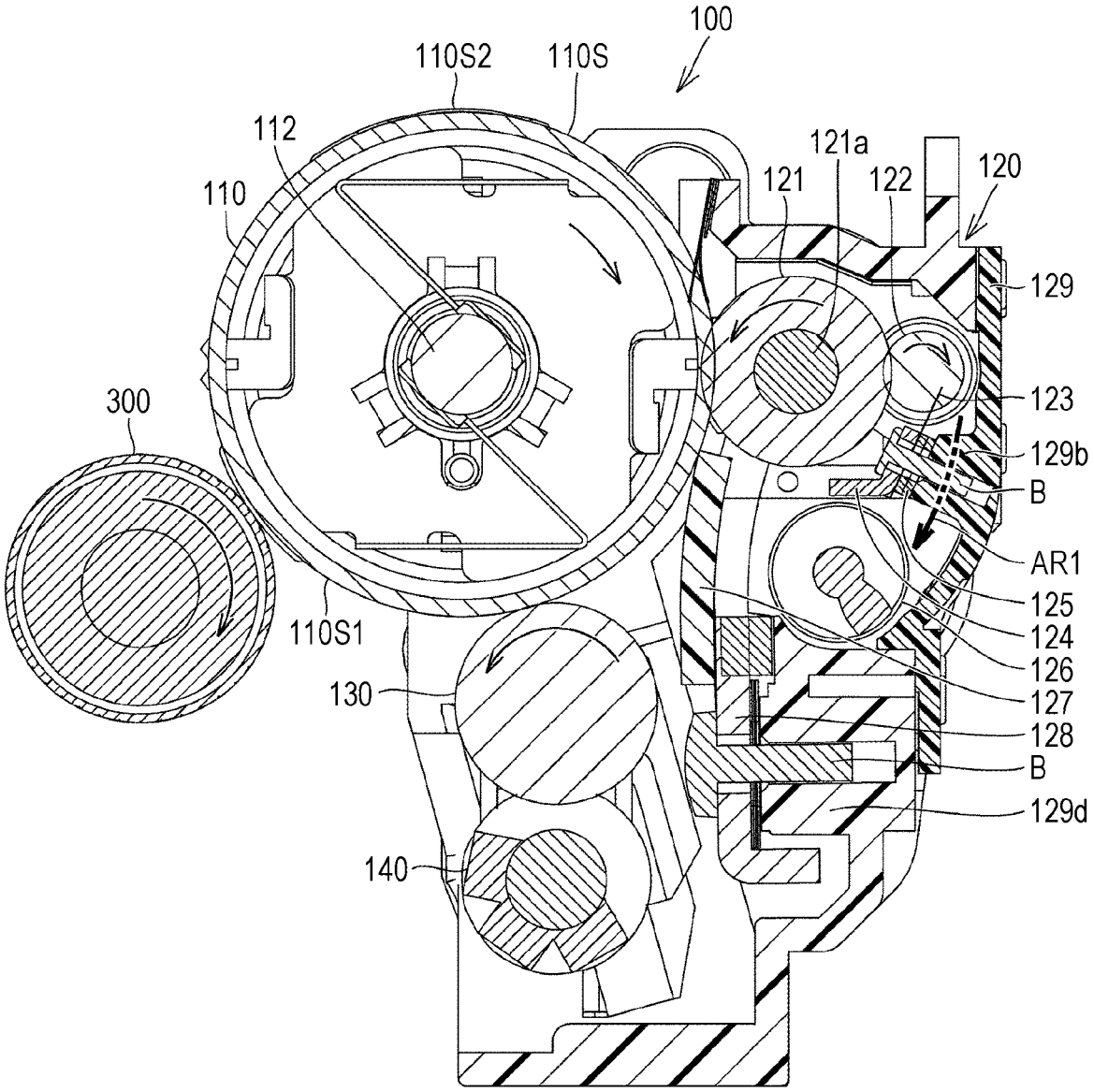
FIG. 3 is a cross-sectional view of a drum unit.

The photoreceptor 110 is rotatable about a rotation shaft 112 (see FIG. 3). A surface 110S (see FIG. 3) of the photoreceptor 110 forms a photosensitive layer that rotates in accordance with a rotation of the rotation shaft 112.

The cleaning device 120 removes residual toner adhering to the surface 110S of the photoreceptor 110. Details of the cleaning device 120 will be described later.

The charging roller 130 charges the surface 110S of the photoreceptor 110 to a predetermined potential The charging roller 130 is disposed so as to be in contact with the surface 110S of the photoreceptor 110.

The cleaning roller 140 cleans the charging roller 130. The cleaning roller 140 is disposed so as to be in contact with a surface of the charging roller 130.

The exposure device 200 forms a latent image by exposing (irradiating with a laser or the like) an exposure part 11051 (see FIGS. 1 and 3) positioned on a downstream side of the charging roller 130 in a rotation direction of the photoreceptor 110 on the surface 110S of the photoreceptor 110. In the embodiment, the exposure device 200 is disposed below the photoreceptor 110.

The developing device 300 is provided on a downstream side of the charging roller 130 in the rotation direction of the photoreceptor 110. The developing device 300 forms a toner image by supplying toner to the latent image. The toner image is transferred to the transfer device 20 at a transfer portion 110S2 (see FIGS. 1 and 3) positioned on a downstream side of the developing device 300 in the rotation direction of the photoreceptor 110 on the surface 110S of the photoreceptor 110. In the embodiment, a developing roller is used as the developing device 300.

Here, the cleaning device 120 will be described. As illustrated in FIG. 3, the cleaning device 120 includes a brush-like rotation body 121, a collection member 122, a blade member 123, a support member 124, an auxiliary plate 125, a conveyance member 126, a cleaning blade 127, an attachment member 128, and a housing 129.

Figure 2:
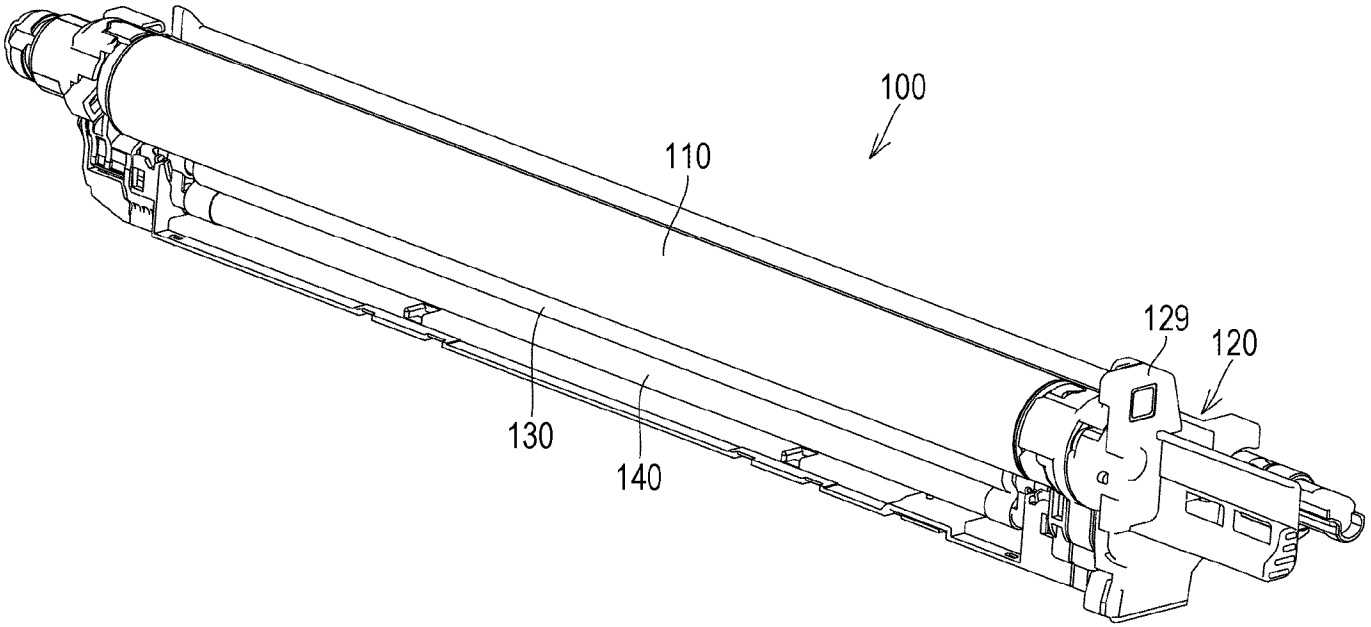
FIG. 2 is a perspective view of a drum unit.

The housing 129 houses the brush-like rotation body 121, the collection member 122, the blade member 123, the support member 124, the auxiliary plate 125, the conveyance member 126, the cleaning blade 127, and the attachment member 128. As illustrated in FIGS. 2 and 3, the housing 129 holds the photoreceptor 110, the charging roller 130, and the cleaning roller 140 in a state in which the photoreceptor 110, the charging roller 130, and the cleaning roller 140 are exposed.

The housing 129 includes an inner side surface 129*a*, a plurality of fixing portions 129*b*, a rib 129*c*, an attachment portion 129*d*, a discharge port 129*e*, a guide surface 129*f*, and a positioning portion 129*g*.

The inner side surface 129*a* forms a part of a discharge path (path indicated by an arrow AR1 or an arrow AR2) of the residual toner scraped off from the collection member 122.

Figure 10:
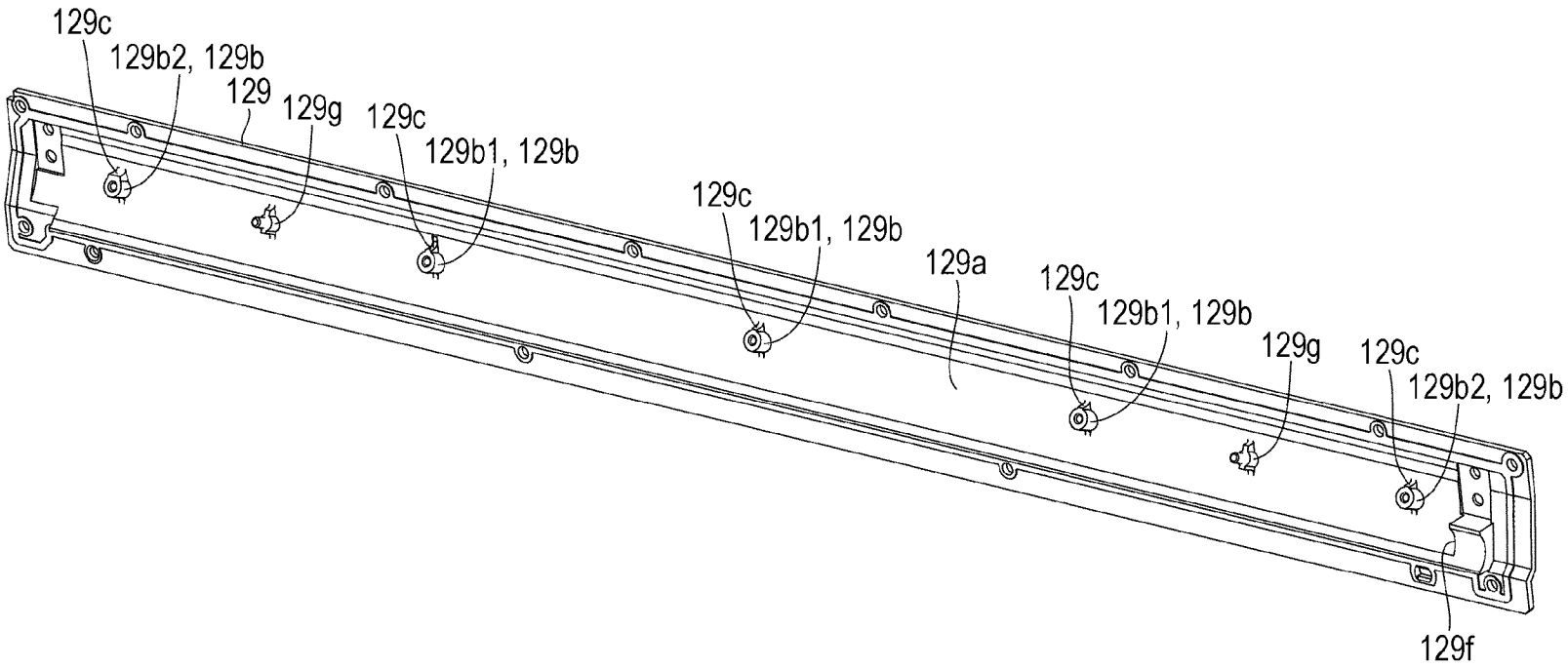
FIG. 10 is a perspective view of a housing.

A plurality of the fixing portions 129*b* includes five fixing portions 129*b*. Each of the fixing portions 129*b* is a portion for fixing the support member 124. Each of the fixing portions 129*b* has a shape protruding from the inner side surface 129*a*. As indicated by the arrow AR1 in FIG. 12, the discharge path is formed between the fixing portions 129*b* adjacent to each other. As illustrated in FIG. 10, each of the fixing portions 129*b* is disposed at intervals in an axial direction parallel to a rotation shaft 121*a* of the brush-like rotation body 121. In the embodiment, a plurality of the fixing portions 129*b* includes a central fixing portion 129*b*1 and an outer fixing portion 129*b*2.

The central fixing portion 129*b*1 is disposed at a central portion of the housing 129 in the axial direction. In the embodiment, three fixing portions 129*b* disposed at the center in the axial direction among the five fixing portions 129*b* forms the central fixing portion 129*b*1.

The outer fixing portion 129*b*2 is disposed outside the central fixing portion 129*b*1 in the axial direction. A protrusion amount of the outer fixing portion 129*b*2 from the inner side surface 129*a* is different from a protrusion amount of the central fixing portion 129*b*1 from the inner side surface 129*a*. The protrusion amount of the outer fixing portion 129*b*2 from the inner side surface 129*a* is determined depending on a warping direction of the inner side surface 129*a*. In the embodiment, the protrusion amount of the outer fixing portion 129*b*2 from the inner side surface 129*a* is greater than the protrusion amount of the central fixing portion 129*b*1 from the inner side surface 129*a*. However, the protrusion amount of the outer fixing portion 129*b*2 from the inner side surface 129*a* may be set to be less than the protrusion amount of the central fixing portion 129*b*1 from the inner side surface 129*a*.

Figure 11:
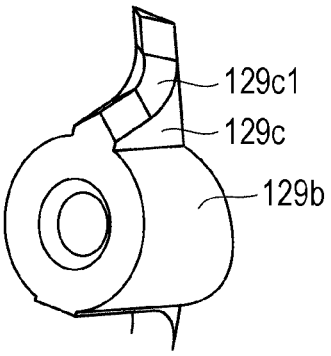
FIG. 11 is a perspective view of a fixing portion and a rib.

The rib 129*c* is provided on each of the fixing portions 129*b*. As illustrated in FIG. 11, an upper end 129*c*1 of the rib 129*c* has a shape of which a dimension in the axial direction gradually increases as being directed toward a lower side.

The attachment portion 129*d* is a portion for attaching the attachment member 128. The attachment portion 129*d* is provided below the fixing portion 129*b*. The attachment portion 129*d* has a shape protruding from the inner side surface 129*a*.

Figure 12:
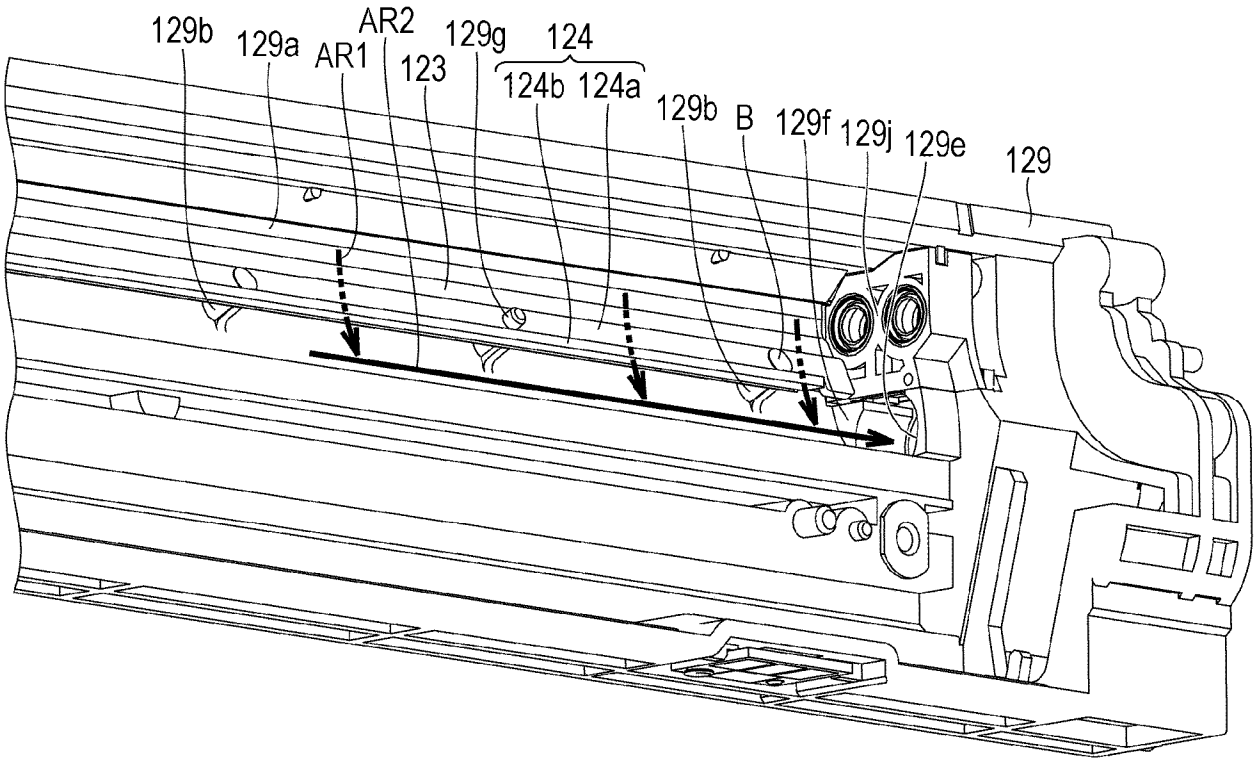
FIG. 12 is a perspective view illustrating a housing, a blade member, and a support member.
Figure 13:
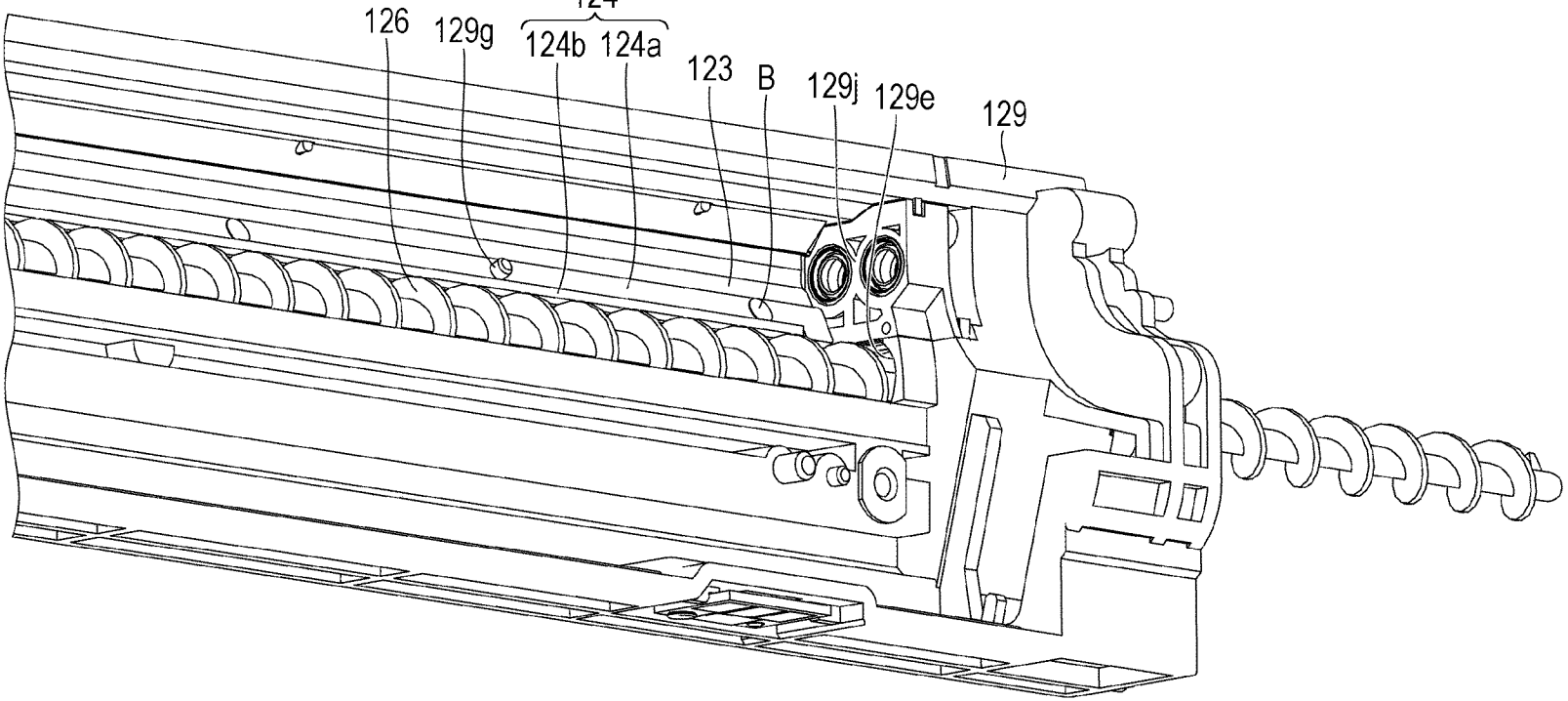
FIG. 13 is a perspective view illustrating a housing, a blade member, a support member, and a conveyance member.

The discharge port 129*e* forms a part of the discharge path. As illustrated in FIG. 12, the discharge port 129*e* is formed below a portion 129*j* in which the brush-like rotation body 121 and the collection member 122 are supported. As illustrated in FIG. 13, the conveyance member 126 is inserted through the discharge port 129*e*.

The guide surface 129*f* guides the residual toner scraped off from the collection member 122 toward the discharge port 129*e*. As illustrated in FIG. 12, the guide surface 129*f* is provided between the inner side surface 129*a* and the discharge port 129*e*. The guide surface 129*f* has a shape gradually away from the inner side surface 129*a* as directed toward a downstream side of the discharge path.

The positioning portion 129*g* is a portion that determines a position of the support member 124. The positioning portion 129*g* protrudes from the inner side surface 129*a*. The positioning portion 129*g* is provided between the central fixing portion 129*b*1 and the outer fixing portion 129*b*2. The positioning portion 129*g* determines a position of the support member 124 in the axial direction with respect to the inner side surface 129*a* and a position in a direction orthogonal to the axial direction.

The brush-like rotation body 121 is disposed so as to be in contact with the surface 110S of the photoreceptor 110. Specifically, the brush-like rotation body 121 is disposed so as to be in contact with a portion on a downstream side of the transfer portion 110S2 in the rotation direction of the photoreceptor 110 on the surface 110S of the photoreceptor 110. While rotating relative to the photoreceptor 110, the brush-like rotation body 121 collects residual toner adhering to the surface 110S of the photoreceptor 110 from the photoreceptor 110 and holds the residual toner.

The collection member 122 is disposed so as to be in contact with the brush-like rotation body 121. The collection member 122 collects the residual toner held by the brush-like rotation body 121 from the brush-like rotation body 121. The collection member 122 is disposed in a state of biting into the brush-like rotation body 121 by a predetermined amount. In the embodiment, a collection roller is used as the collection member 122. A gap between the collection member 122 and the inner side surface 129*a* is set to have a size with which the toner can pass through. The size of the gap may be about 0.1 mm. In the embodiment, the size of the gap is set to about 1 mm.

Figure 4:
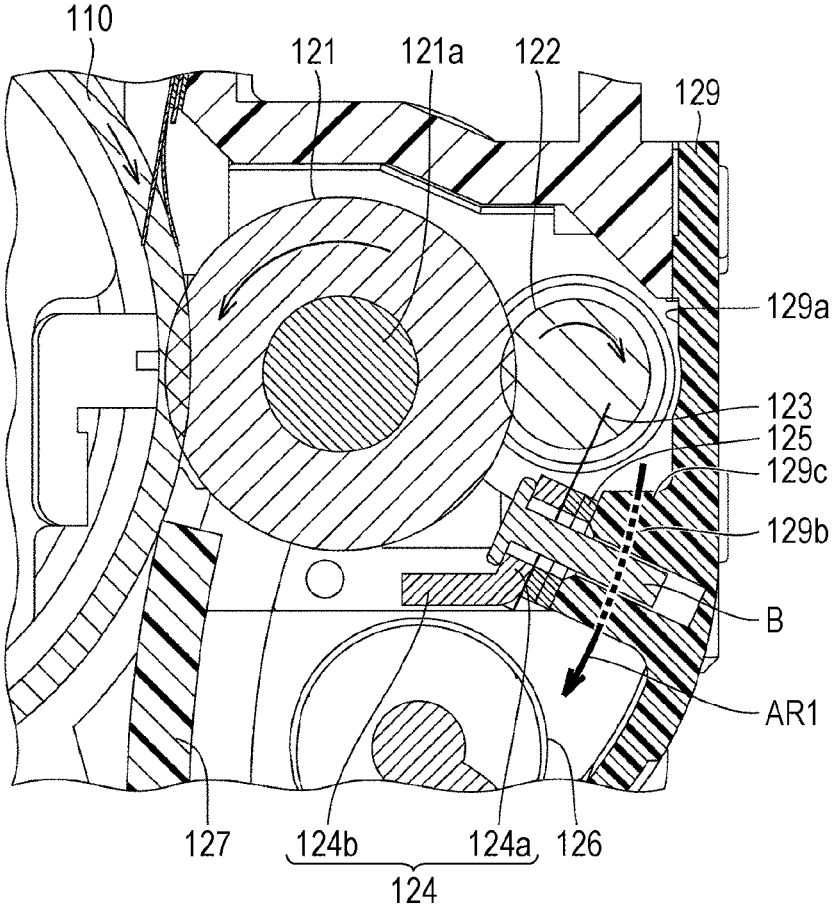
FIG. 4 is a cross-sectional view of a vicinity of a blade member.
Figure 5:
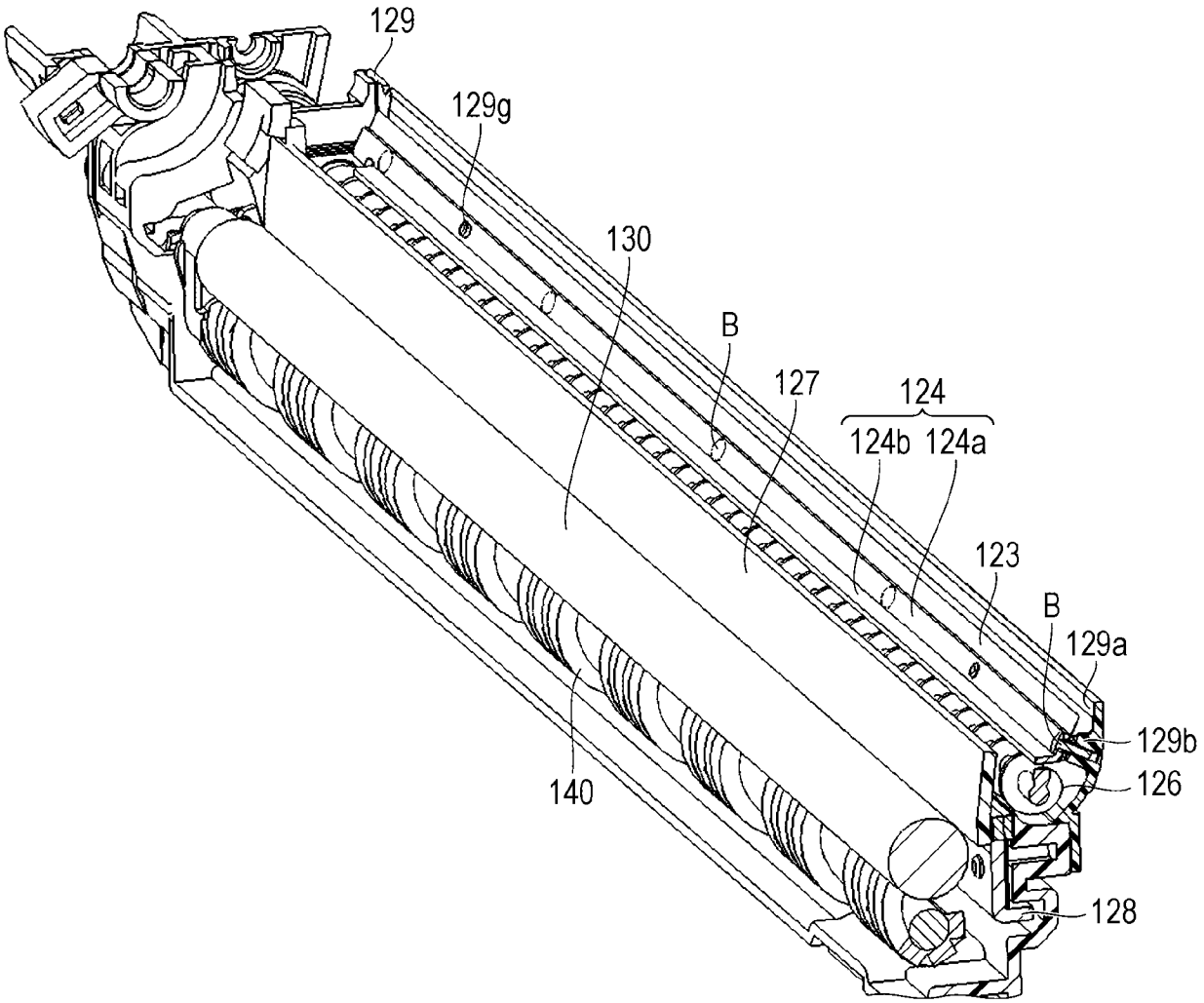
FIG. 5 is a cross-sectional perspective view of a part of a drum unit.
Figure 6:
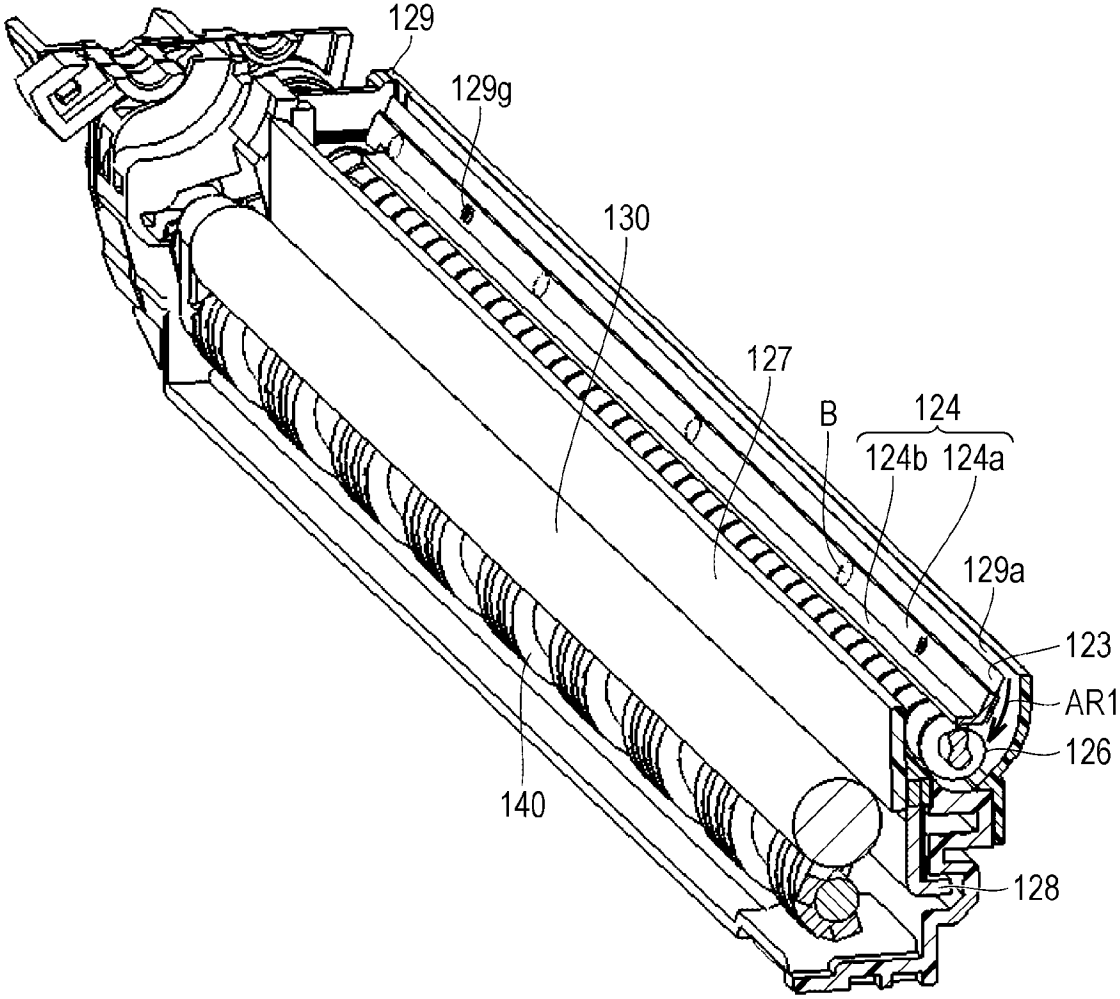
FIG. 6 is a cross-sectional perspective view of a part of a drum unit.
Figure 7:
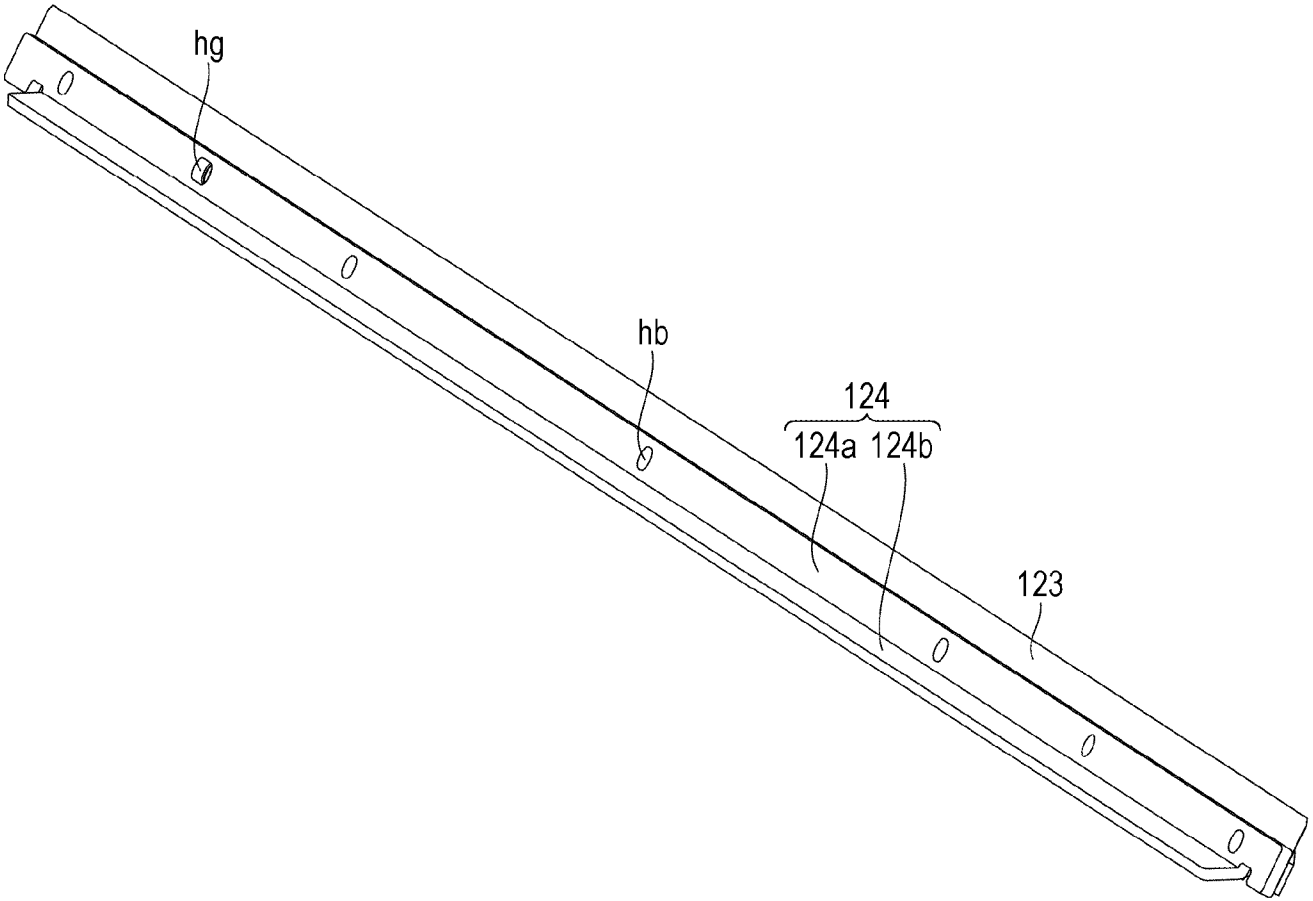
FIG. 7 is a perspective view of a blade member and a support member.
Figure 8:
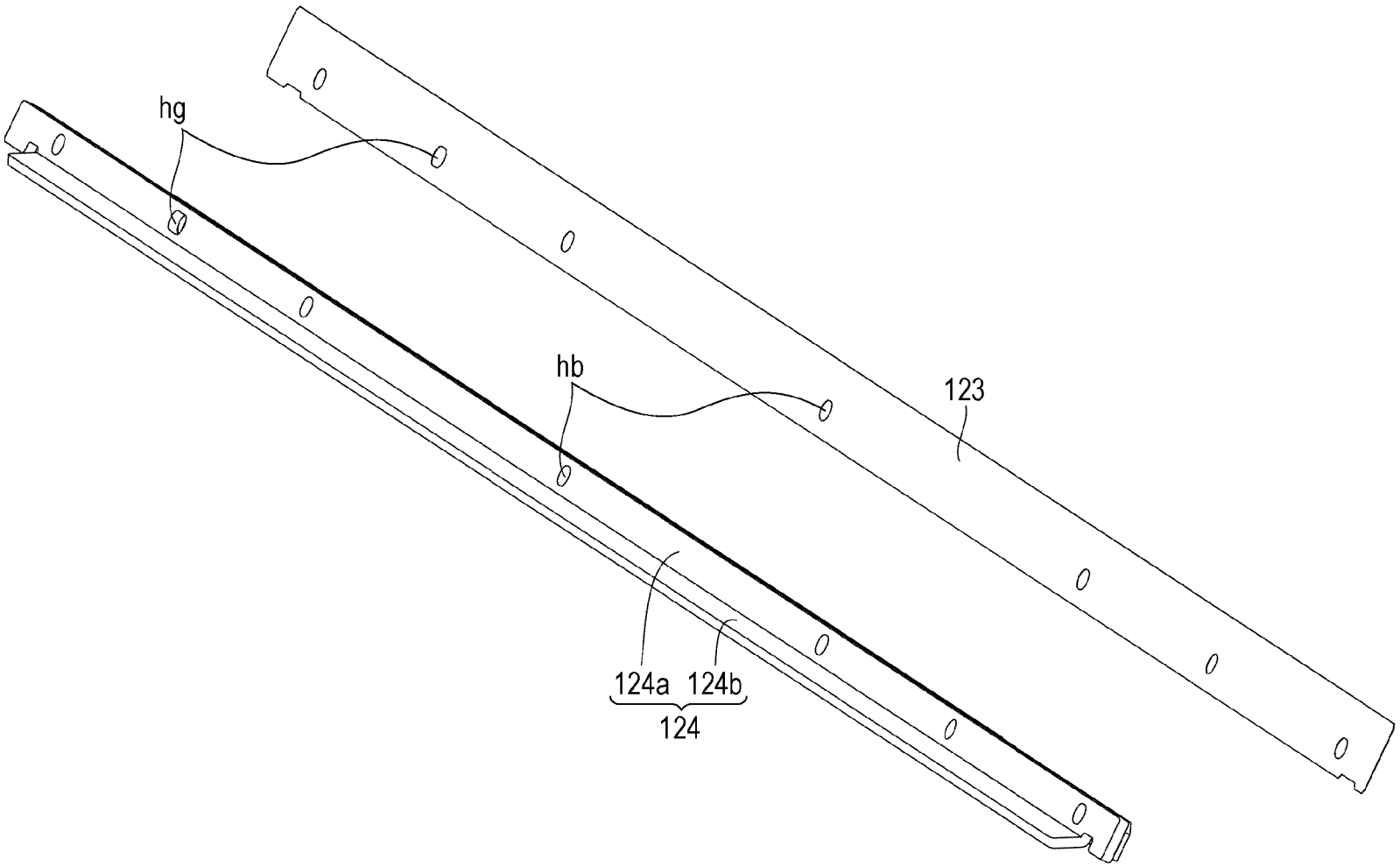
FIG. 8 is an exploded perspective view of a blade member and a support member.

The blade member 123 scrapes off the residual toner collected by the collection member 122 from the collection member 122. As illustrated in FIGS. 5 to 8, the blade member 123 is formed in a thin plate shape. The blade member 123 is made of metal, urethane rubber, or the like. As illustrated in FIGS. 3 and 4, the blade member 123 is supported at an angle at which the blade member 123 is gradually away from the inner side surface 129*a* as being directed downward. The blade member 123 is supported at an angle at which an upper end of the blade member 123 comes into pressure contact with the surface of the collection member 122. FIGS. 3 and 4 illustrate a state in which the upper end of the blade member 123 bites into the collection member 122, but actually, the upper end of the blade member 123 is bent so as to come into pressure contact with the surface of the collection member 122. The upper end of the blade member 123 is in contact with the collection member 122 below a position in which the gap between the collection member 122 and the inner side surface 129*a* is the smallest. As illustrated in FIG. 8, the blade member 123 is provided with an insertion hole hb through which a bolt B is inserted and a positioning hole hg through which the positioning portion 129*g* is inserted.

The support member 124 supports the blade member 123. The support member 124 is made of, for example, metal. The support member 124 is disposed below the brush-like rotation body 121 and the collection member 122 and at a position overlapping the brush-like rotation body 121 and the collection member 122 in the vertical direction. As illustrated in FIGS. 4 to 8, the support member 124 includes a support part 124*a* and a restriction part 124*b*.

The support part 124*a* supports the blade member 123. As illustrated in FIGS. 7 and 8, the support part 124*a* is provided with an insertion hole hb through which a bolt B is inserted and a positioning hole hg through which the positioning portion 129*g* is inserted. In the embodiment, the support part 124*a* supports the blade member 123 by fixing the bolt B to the fixing portion 129*b* through each insertion hole hb formed in the blade member 123 and the support part 124*a*. The support part 124*a* supports the blade member 123 such that the blade member 123 is in an orientation extending upward from the support part 124*a*. The support part 124*a* is disposed below the collection member 122.

The restriction part 124*b* is disposed above the conveyance member 126, and restricts contact of the conveyance member 126 with the brush-like rotation body 121 and the collection member 122. The restriction part 124*b* is disposed below the brush-like rotation body 121 and the collection member 122. The restriction part 124*b* has a shape covering a top part of the conveyance member 126. The restriction part 124*b* is connected to the support part 124*a*. The restriction part 124*b* extends from the support part 124*a* in a direction different from the direction in which the blade member 123 extends from the support part 124*a*. Specifically, the restriction part 124*b* has a shape extending from a lower end of the support part 124*a* toward a direction (left side in FIG. 4) away from the inner side surface 129*a* of the housing 129. The restriction part 124*b* is formed of the same member as the support part 124*a*. In the embodiment, the restriction part 124*b* and the support part 124*a* are formed by bending a metal plate.

The auxiliary plate 125 assists the blade member 123. The auxiliary plate 125 is disposed between the fixing portions 129*b* and the blade member 123. In other words, the blade member 123 is disposed between the support member 124 and the auxiliary plate 125. As illustrated in FIG. 4, an upper end surface of the auxiliary plate 125 is flush with an upper end surface of the support part 124*a*. The upper end surface of the auxiliary plate 125 is positioned below the rib 129*c*. A bending portion of the blade member 123 is defined by an upper end of the auxiliary plate 125. That is, the auxiliary plate 125 has a function of determining a length (free length) of the bending portion of the blade member 123. The auxiliary plate 125 also has a function of forming a gap between the blade member 123, and the fixing portion 129*b* and the rib 129*c*.

Figure 9:
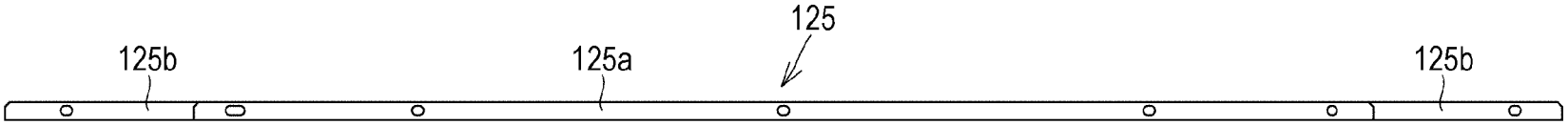
FIG. 9 is a front view of an auxiliary plate.

As illustrated in FIG. 9, the auxiliary plate 125 includes a high rigidity portion 125*a* and a low rigidity portion 125*b*. The high rigidity portion 125*a* is formed at a central portion in the axial direction. The low rigidity portion 125*b* is formed at an end portion in the axial direction, and has rigidity lower than that of the high rigidity portion 125*a*. A thickness of the low rigidity portion 125*b* is set to be smaller than a thickness of the high rigidity portion 125*a*. In the embodiment, the auxiliary plate 125 is formed by overlapping two plate members having different lengths, a portion formed by overlapping the two plate members forms the high rigidity portion 125*a*, and a portion formed of one plate member forms the low rigidity portion 125*b*.

Formation positions of the high rigidity portion 125*a* and the low rigidity portion 125*b* are determined depending on the warping direction of the inner side surface 129*a*. In the embodiment, the high rigidity portion 125*a* is formed at the central portion in the axial direction, and the low rigidity portion 125*b* is formed at the end portion in the axial direction. However, in a case where the warp direction of the inner side surface 129*a* is reversed, the low rigidity portion 125*b* may be formed at the central portion in the axial direction, and the high rigidity portion 125*a* may be formed at the end portion in the axial direction.

The conveyance member 126 is disposed below the brush-like rotation body 121 and the collection member 122. The conveyance member 126 conveys the residual toner scraped off from the collection member 122 by the blade member 123 toward the downstream side of the discharge path as indicated by the arrow AR2. The conveyance member 126 is disposed below the restriction part 124*b*. As illustrated in FIG. 4, the top part of the conveyance member 126 is covered by a lower portion of the restriction part 124*b*. As illustrated in FIG. 13, the conveyance member 126 is inserted into the discharge port 129*e*. The conveyance member 126 has a shape extending in a direction parallel to the rotation shaft 121*a* of the brush-like rotation body 121. In the embodiment, a conveyance screw is used as the conveyance member 126.

The cleaning blade 127 is provided between the brush-like rotation body 121 and the charging roller 130 in the rotation direction of the photoreceptor 110. The cleaning blade 127 removes the residual toner adhering to a portion on a downstream side of the brush-like rotation body 121 on the surface 110S of the photoreceptor 110. The cleaning blade 127 is formed in a plate shape. The cleaning blade 127 has a shape extending along the axial direction of the rotation shaft 112. The cleaning blade 127 is formed of, for example, a resin material such as urethane. As illustrated in FIG. 3, the cleaning blade 127 is attached to the attachment portion 129*d* of the housing 129 by an attachment member 128 and the bolt B.

As described above, in the cleaning device 120 of the embodiment, since the support member 124 is fixed to a plurality of the fixing portions 129*b* of the housing 129, deformation of the support member 124 is effectively suppressed. According to this, since deformation of the blade member 123 is suppressed, a contact pressure of the blade member 123 with respect to the collection member 122 is prevented from being non-uniform.

In the cleaning device 120, since the restriction part 124*b* is disposed above the conveyance member 126, the conveyance member 126 is prevented from coming into contact with the brush-like rotation body 121 and the collection member 122.

Figure 14:
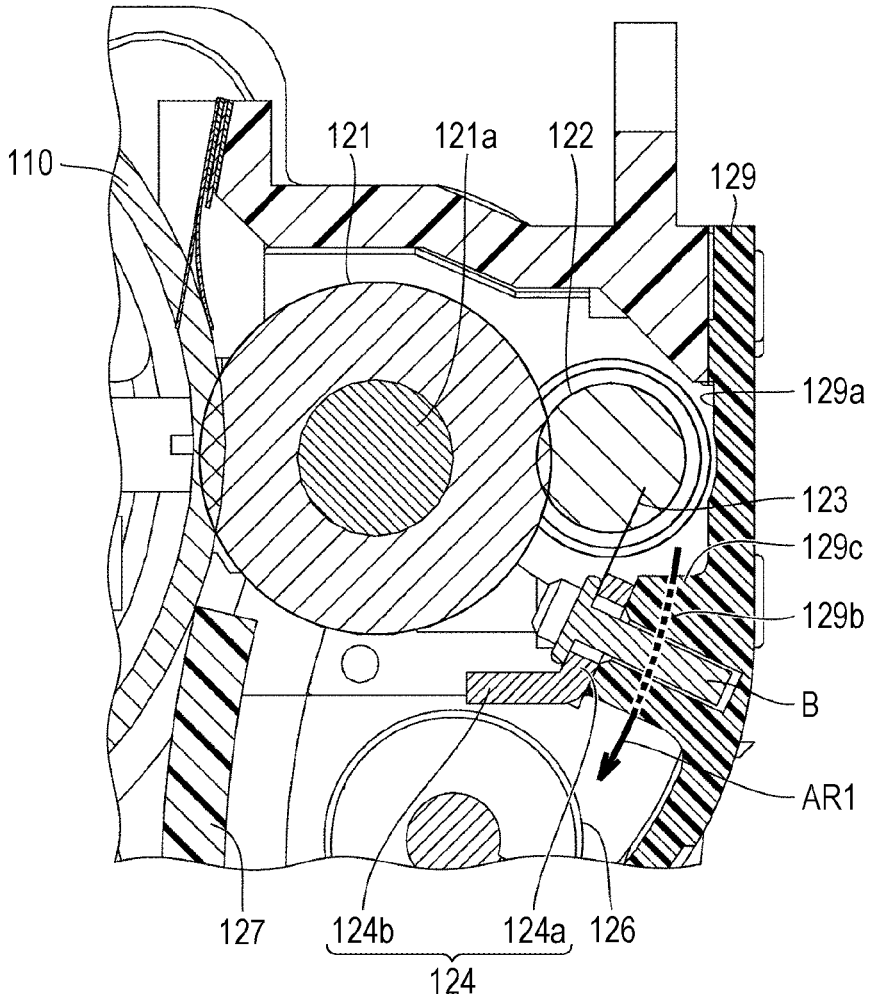
FIG. 14 is a cross-sectional view illustrating a modified example of a supported state of a blade member.

In the above embodiment, for example, as illustrated in FIG. 14, the blade member 123 may be disposed between a head portion of the bolt B and the support part 124*a*. In this aspect, since the support part 124*a* also functions as the auxiliary plate 125, the auxiliary plate 125 is omitted.

As illustrated in FIG. 15, the rib 129*c* may be formed in a shape gradually inclined downward as being away from the inner side surface 129*a*.

The support part 124*a* may be formed separately from the restriction part 124*b*.

It is understood by those skilled in the art that the exemplary embodiment described above is a specific example of the following aspect.

The cleaning device according to an aspect of the embodiment described above includes: a brush-like rotation body that collects residual toner adhering to a photoreceptor from the photoreceptor and holds the residual toner; a collection member that is disposed so as to be in contact with the brush-like rotation body and collects the residual toner held by the brush-like rotation body from the brush-like rotation body; a blade member that scrapes off the residual toner collected by the collection member from the collection member; a support member that supports the blade member; a conveyance member that is disposed below the collection member and conveys the residual toner scraped off from the collection member by the blade member; and a housing that houses the brush-like rotation body, the collection member, the blade member, the support member, and the conveyance member, in which the housing includes an inner side surface forming a part of a discharge path of the residual toner scraped off from the collection member, and a plurality of fixing portions disposed at intervals in an axial direction parallel to a rotation shaft of the brush-like rotation body and for fixing the support member, each of a plurality of the fixing portions has a shape protruding from the inner side surface, a space between the fixing portions adjacent to each other forms the discharge path, and the support member is fixed to a plurality of the fixing portions.

In the cleaning device, since the support member is fixed to a plurality of the fixing portions of the housing, deformation of the support member is effectively suppressed. According to this, since deformation of the blade member is suppressed, a contact pressure of the blade member with respect to the collection member is prevented from being non-uniform.

It is preferable that the housing further includes a rib provided on an upper portion of each of the fixing portions, and an upper end of the rib has a shape of which a dimension in the axial direction gradually increases as being directed downward.

In this manner, the residual toner scraped off from the collection member is prevented from being accumulated on each of the fixing portions.

It is preferable that the housing further includes a discharge port through which the conveyance member is inserted and which forms a part of the discharge path, and a guide surface which is provided between the inner side surface and the discharge port and guides the residual toner scraped off from the collection member toward the discharge port.

In this manner, the residual toner between the inner side surface of the housing and the discharge port is prevented from being accumulated.

It is preferable that an auxiliary plate that assists the blade member is further provided, and the auxiliary plate is disposed between the fixing portion and the blade member.

In this aspect, since the gap is formed between the blade member and the fixing portion by the auxiliary plate, the blade member is prevented from interfering with the fixing portion.

It is preferable that the auxiliary plate includes a high rigidity portion formed at a center portion in the axial direction, and a low rigidity portion formed at an end portion in the axial direction and having rigidity lower than that of the high rigidity portion.

In this manner, in a case where the housing is warped, since the low rigidity portion of the auxiliary plate is mainly bent to effectively regulate the warpage of the housing, the contact pressure of the blade member with respect to the collection member is prevented from being non-uniform.

It is preferable that a plurality of the fixing portions include: a central fixing portion disposed at a central portion of the housing in the axial direction; and an outer fixing portion disposed outside the central fixing portion in the axial direction, the outer fixing portion having a protrusion amount from the inner side surface different from that of the central fixing portion.

The cleaning device according to another aspect of the embodiment described above includes: a brush-like rotation body that collects residual toner adhering to a photoreceptor from the photoreceptor and holds the residual toner; a collection member that is disposed so as to be in contact with the brush-like rotation body and collects the residual toner held by the brush-like rotation body from the brush-like rotation body; a blade member that scrapes off the residual toner collected by the collection member from the collection member; a conveyance member that is disposed below the brush-like rotation body and the collection member and conveys the residual toner scraped off from the collection member by the blade member; and a restriction part that is disposed above the conveyance member and restricts contact of the conveyance member with the brush-like rotation body and the collection member.

In the cleaning device, since the restriction part is disposed above the conveyance member, the conveyance member is prevented from coming into contact with the brush-like rotation body and the collection member.

It is preferable that the restriction part has a shape that covers a top part of the conveyance member.

In this manner, the conveyance member is reliably prevented from coming into contact with the brush-like rotation body and the collection member.

It is preferable that the cleaning device further includes a support part that is connected to the restriction part and supports the blade member.

In this manner, it is easy to handle the restriction part and the support part.

It is preferable that the cleaning device further includes a housing that houses the brush-like rotation body, the collection member, the blade member, the conveyance member, the restriction part, and the support part, the support part is fixed to the housing, and the restriction part has a shape extending from an end of the support part in a direction away from the housing.

In this aspect, both the fixing of the blade member to the housing and the suppression of the contact of the conveyance member with the brush-like rotation body and the collection member are achieved.

It is preferable that the restriction part and the support part are formed by bending a metal plate.

The drum unit in the embodiment described above includes the cleaning device and the photoreceptor, and the photoreceptor is held by the housing.

The image forming apparatus according to the embodiment described above includes the drum unit, a charging roller that is disposed so as to be in contact with a surface of the photoreceptor and charges the surface of the photoreceptor, an exposure device that forms a latent image by exposing an exposure part positioned on a downstream side of the charging roller in a rotation direction of the photoreceptor on the surface of the photoreceptor, and a developing device that is provided on a downstream side of the charging roller in the rotation direction of the photoreceptor and forms a toner image by supplying toner to the latent image.

Although embodiments of the present invention have been described and illustrated in detail, the disclosed embodiments are made for purposes of illustration and example only and not limitation. The scope of the present invention should be interpreted by terms of the appended claims, and it is intended that meanings equivalent to the claims and all modifications within the scope are included.

What is claimed is:

1. A cleaning device comprising:

a brush-like rotation body that collects residual toner adhering to a photoreceptor from the photoreceptor and holds the residual toner;

a collection member that is disposed so as to be in contact with the brush-like rotation body and collects the residual toner held by the brush-like rotation body from the brush-like rotation body;

a blade member that scrapes off the residual toner collected by the collection member from the collection member;

a conveyance member that is disposed below the brush-like rotation body and the collection member and conveys the residual toner scraped off from the collection member by the blade member; and a restriction part that is disposed above the conveyance member and restricts contact of the conveyance member with the brush-like rotation body and the collection member.

2. The cleaning device according to claim 1, wherein the restriction part has a shape that covers a top part of the conveyance member.

3. The cleaning device according to claim 1, further comprising a support part that is connected to the restriction part and supports the blade member.

4. The cleaning device according to claim 3, further comprising a housing that houses the brush-like rotation body, the collection member, the blade member, the conveyance member, the restriction part, and the support part, wherein the support part is fixed to the housing, and the restriction part has a shape extending from an end of the support part in a direction away from the housing.

5. A drum unit comprising:

the cleaning device according to claim 4; and the photoreceptor, wherein the photoreceptor is held by the housing.

6. An image forming apparatus comprising:

the drum unit according to claim 5;

a charging roller that is disposed so as to be in contact with a surface of the photoreceptor and charges the surface of the photoreceptor;

an exposure device that forms a latent image by exposing an exposure part positioned on a downstream side of the charging roller in a rotation direction of the photoreceptor on the surface of the photoreceptor; and a developing device that is provided on a downstream side of the charging roller in the rotation direction of the photoreceptor and forms a toner image by supplying toner to the latent image.

7. The cleaning device according to claim 3, wherein the restriction part and the support part are formed by bending a metal plate.

* * * * *